US010532600B1

(12) United States Patent
Moore

(10) Patent No.: US 10,532,600 B1
(45) Date of Patent: Jan. 14, 2020

(54) WRITING INSTRUMENT WITH LOCKING CAP

(71) Applicant: Christian John James Moore, Orlando, FL (US)

(72) Inventor: Christian John James Moore, Orlando, FL (US)

( * ) Notice: Subject to any disclaimer, the term of this patent is extended or adjusted under 35 U.S.C. 154(b) by 44 days.

(21) Appl. No.: 15/861,618

(22) Filed: Jan. 3, 2018

Related U.S. Application Data

(63) Continuation-in-part of application No. 15/416,830, filed on Jan. 26, 2017, now Pat. No. 10,286,724.

(60) Provisional application No. 62/341,288, filed on May 25, 2016, provisional application No. 62/287,485, filed on Jan. 27, 2016.

(51) Int. Cl.
*B43K 23/12* (2006.01)
*B65D 50/04* (2006.01)

(52) U.S. Cl.
CPC ..... *B43K 23/12* (2013.01); *B65D 50/046* (2013.01)

(58) Field of Classification Search
CPC ..... B43K 23/08; B43K 23/10; B43K 23/12; B43K 23/122; B43K 23/124; B43K 23/126; B43K 23/128; B65D 39/10; B65D 50/045; B65D 50/046; B65D 50/066
USPC ..... 215/216, 222; 220/302
See application file for complete search history.

(56) References Cited

U.S. PATENT DOCUMENTS 2,192,644 A 3/1940 La May et al.
3,931,983 A 1/1976 Kanoouse et al.
4,270,664 A 6/1981 Buono
4,979,840 A 12/1990 Madaus
5,336,011 A 8/1994 Ferguson et al.
5,551,582 A 9/1996 Robinson
5,577,624 A * 11/1996 Berta ..... B65D 50/045 215/221
6,626,600 B1 9/2003 Brand et al.
6,890,118 B2 5/2005 Oike
7,334,694 B2 2/2008 Suffa
8,282,302 B2 10/2012 Zahn et al.
(Continued)

FOREIGN PATENT DOCUMENTS

CN 203818808 9/2014
CN 103738077 10/2015
(Continued)

OTHER PUBLICATIONS

Rao Daoxin, Abstract of CN103738077, obtained at <https://worldwide.espacenet.com/publicationDetails/biblio?II=0&ND=3&adjacent=true&locale=en_EP&FT=D&date=20140423&CC=CN&NR=103738077A&KC=A> on Jan. 3, 2018.
(Continued)

*Primary Examiner* — David P Angwin
*Assistant Examiner* — Bradley S Oliver
(74) *Attorney, Agent, or Firm* — Hanrahan Law Firm, P.A.; Benjamin M. Hanrahan

(57) ABSTRACT

A writing instrument with a cap that lockingly engages a body portion via a locking assembly is presented herein. The locking assembly includes a pair of locking tabs on the cap that correspondingly fit within locking channels on the body of the writing instrument. With the tabs positioned within the locking channels, the cap is twisted or rotated such that the locking tabs slide past a node within the channels and restricts removal of the cap from the body portion.

8 Claims, 9 Drawing Sheets

(56) References Cited

U.S. PATENT DOCUMENTS

| | | | | |
|---|---|---|---|---|
| 8,540,450 | B1 * | 9/2013 | Conable | B43K 23/128 401/243 |
| 10,286,724 | B1 | 5/2019 | Moore | |
| 2005/0205607 | A1 | 9/2005 | Hierzer et al. | |
| 2011/0206444 | A1 * | 8/2011 | Rosica | B43K 23/08 401/195 |
| 2012/0187074 | A1 | 7/2012 | Glynn | |

FOREIGN PATENT DOCUMENTS

| | | |
|---|---|---|
| CN | 103738079 | 4/2016 |
| WO | 9418013 | 8/1994 |

OTHER PUBLICATIONS

Rao Daoxin, English Translation of CN103738077, obtained at <https://www.google.com.pg/patents/CN103738077A?cl=en> on Jan. 3, 2018.

Zhang Yujie, Abstract of CN103738079 A, obtained at <https://worldwide.espacenet.com/publicationDetails/biblio?II=0&ND=3&adjacent=true&locale=en_EP&FF=D&date=20140423&CC=CN&NR=103738079A&KC=A> on Jan. 3, 2018.

Zhang Yujie, English Translation of CN103738079 A, obtained at <https://www.google.com/patents/CN103738079A?cl=en&dq=CN103738079+A> on Jan. 3, 2018.

Zhang Yujie, Abstract of CN203818808, obtained at <https://worldwide.espacenet.com/publicationDetails/biblio?II=0&ND=3&adjacent=true&locale=en_EP&FT=D&date=20140910&CC=CN&NR=203818808U&KC=U> on Jan. 3, 2018.

Zhang Yujie, English Translation of CN203818808, obtained at <https://www.google.com/patents/CN203818808U?cl=en&dq=CN203818808> on Jan. 3, 2018.

amazon.com | "Amazon.com: Crayola 6 Flip Top Markers: Toys & Games" | obtained at <https://www.amazon.com/Crayola-6-Flip-Top-Markers/dp/B001BELVIE/ref=pd_sim_21_1?ie=UTF8&dpID=514le88Sj3L&dpSrc=sims&p> on Jan. 3, 2018.

amazon.com | "Amazon.com: BIN5864410—Crayola Twistable Marker: Toys & Games" | obtained at <https://www.amazon.com/gp/product/B000EYF6V0/ref=s9_simh_gw_g21_i3_r?pf_rd_m=> on Jan. 3, 2018.

amazon.com | "Amazon.com : Sharpie Retractable Permanent Markers, Fine Point, Assorted Colors, 12 Count : Office Products" | obtained at <http://www.amazon.com/gp/product/B000EYF6V0/> on Jan. 3, 2018.

* cited by examiner

WRITING INSTRUMENT WITH LOCKING CAP

CLAIM OF PRIORITY/CROSS REFERENCE TO RELATED APPLICATIONS

The present application is a Continuation-In-Part (CIP) Patent Application of previously filed, currently U.S. patent application Ser. No. 15/416,830 filed on Jan. 26, 2017, which is based on and claims priority under 35 U.S.C. § 119(e) to Provisional Patent Application Ser. No. 62/287,485, filed on Jan. 27, 2016, and which also claims priority to Provisional Patent Application Ser. No. 62/341,288, filed on May 25, 2016.

The contents of all prior applications, namely, U.S. patent application Ser. No. 15/416,830, U.S. Provisional Patent Application Ser. No. 62/341,288, and U.S. Provisional Patent Application Ser. No. 62/287,485, are incorporated herein in their entirety by reference.

FIELD OF THE INVENTION

The present invention is generally directed to a child-resistant writing instrument, such as, but not limited to a pen, marker, permanent marker, dry erase marker, dot marker, paint marker, felt tip pen, ball point pen, fountain pen, highlighter, etc., with a cap that can be lockingly engaged to the body portion in order to restrict access to the ink or writing cartridge therein.

BACKGROUND OF THE INVENTION

Markers, pens, and other like writing instruments are found in virtually every home, office and class rooms, including daycares, preschools, public and private schools, etc., yet they can often be extremely harmful to children (e.g., in the form of a choking hazard or ingestion hazard) and can be used, most often by children, to harm or destroy valuables.

For example, the cap of a pen, marker, or other writing instrument can either fall off or be taken off, thereby becoming an extreme choking hazard for children, and particularly children between the ages of 0 and 5. Ingesting the cap, ink or other portion of the pen, marker or writing instrument can also be extremely harmful. In addition, children, particularly between the ages of 0 and 5, can often destroy valuables, such as walls, paintings, furniture, etc. by writing on them with access to pens, markers, etc. In the United States, alone, there are over 23 million children between the ages of 0 and 5, and approximately 4 million children born each year. Furthermore, there are about 67,000 elementary schools in the United States where child access to pens, markers and other writing instruments is abundant.

In addition, sometimes the cap to a marker or pen can be inadvertently dislodged or removed from the writing instrument, for example, while the writing instrument is in a pocket, purse or bag. When this happens, the ink tip of the writing instrument can be exposed, which can then potentially mark and/or damage nearby items (e.g., items in the same pocket, purse or bag) or the pocket, purse or bag, itself.

There is thus a need in the art for a writing instrument with a cap that can lock onto the body portion or base of the writing instrument in order to restrict access to the cap and/or writing tip (e.g., ink tip) by making it difficult for children of a young age to open and/or minimizing or eliminating the possibility of the cap being inadvertently dislodged or removed, e.g., in a pocket, purse or bag. The younger the child, and the less motor skills the child possess, the more likely it is that the child or individual would not be able to remove or unlock the cap of the proposed writing instrument.

The proposed writing instrument with locking cap would help reduce the chances of young children choking on or ingesting the cap(s) and/or the cap being otherwise inadvertently removed or dislodged since the cap will be locked onto the base or body portion of the writing instrument. In some embodiments, the cap can also be locked onto the bottom end or base of the body portion (e.g., when the writing instrument is in use), further preventing access to the cap, alone. In addition, the locked cap would help prevent or reduce the number of children from writing on, and thereby destroying valuables, such as walls, paintings, pictures, furniture, carpet, countertops, clothing, etc.

SUMMARY OF THE INVENTION

The various embodiments of the present invention are directed to a writing instrument with a locking cap, e.g., a cap that lockingly engages with the body portion of the writing instrument in order to restrict inadvertent or unwanted removal thereof. In this manner, the writing instrument of some embodiments or implementations may be considered "child-resistant" in that many children, particularly young children between the ages of 0 and 5, will not be able to or will have great difficulty in removing the cap from the body portion of the writing instrument. The writing instrument of the various embodiments of the present invention disclosed herein can include virtually any instrument structured to write, such as, but not limited to a pen, marker, permanent marker, dry erase marker, dot marker, paint marker, felt tip pen, ball point pen, fountain pen, highlighter, etc.

For example, at least one embodiment includes a locking assembly that is adapted and disposed to lockingly engage the cap to the body portion of the writing instrument. Specifically, one embodiment may include a pair of locking protrusions or tabs extending from a portion of the cap, e.g., a collar, and a pair or corresponding locking channels disposed on the base or body portion of the writing instrument. A biasing mechanism, such as a coil spring, may, in some embodiments, be used to bias the cap into the locked engagement, for example, by pushing the cap, and in particular, the locking pins or locking protrusions, into corresponding locking notches within the channels.

For example, in order to lockingly engage the cap to the body portion, the locking tabs, pins or protrusions are inserted into the locking channels, and the cap is pushed against the biasing force of the spring. This will cause the locking pins or protrusions to enter an inner or intermediate groove where the cap can be twisted or rotated relative to the position of the body portion. At the end of the inner or intermediate groove is a locking notch extending in the direction of the biasing force of the spring such that the spring will bias the locking pins or protrusions into the locking notches. This will lock the cap in place, meaning that attempts to pull the cap off or twist the cap without first pushing against the biasing force will not allow the cap to be removed.

Instead, in order to remove the cap from the body portion, the cap must first be pushed against the force of the biasing mechanism or spring in order to allow the locking pins or protrusions to exit the locking notches and enter the intermediate or inner groove of the locking channels. Then, the cap can be twisted or rotated (in the opposite direction than it was rotated to lock) until the pins or protrusions reach the opening groove or opening of the locking channel. The biasing force from the spring can assist in the removal of the cap from the locking channel and therefore removal of the cap from the body portion.

In yet another embodiment, the locking tabs or protrusions may be disposed on one or more flexible portions of the cap that can be manually pinched or squeezed inward. In addition, one or more nodes may be included within the channel(s) such that the locking tabs can engage the nodes when locked, thereby restricting access to the ink or other writing instrument. Particularly, in order to lock the cap to the body, the locking tab(s) may be inserted into the locking channel(s), and the cap can be twisted or rotated relative to the body. Rotation of the cap will cause the locking tabs to pass over the nodes (e.g., via a sloped or curved surface) and into a locked position. Particularly, with the tabs disposed within the channels, between the nodes and the distal end of the channels, the cap cannot be pulled off of the body. In addition, the cap cannot be unlocked unless the flexible portions of the cap are squeezed or pinched inward, thereby allowing the locking tabs to clear the nodes and subsequently released from the openings of the channels.

Some alternative embodiments of the locking assembly can include, for example, a childproof casing that locks around the writing instrument; a device that locks and opens with a similar push-down, twist-off method; a device that locks and requires a user to push opposite ends of the cap together (e.g., tabs on opposite ends of the cap) to unlock and open; a device where the cap is screwed on and off via cooperative threaded components; a device where the cap attaches (e.g., locks) and detaches (e.g., unlocks) from the body portion via magnets or suction; a device with a buckle-type of lock is used to lock and unlock the cap from the body portion; a device with a retractable string that attaches the cap to the body portion of the writing instrument so that when the cap is unlocked and the writing instrument is open, the cap is still attached to the body portion of the writing instrument via the string, tugging on the cap would tighten the string and retract the cap back onto the base or body portion; etc.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1A:
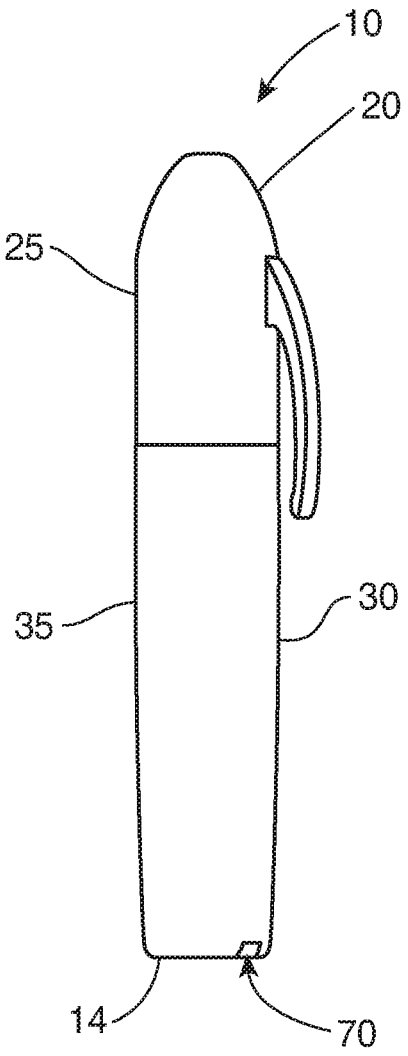
FIG. 1A is a side elevation view of the writing instrument with locking cap as disclosed in accordance with at least one embodiment of the present invention with the cap disposed in a lockingly engaged relation with the body portion.
Figure 1B:
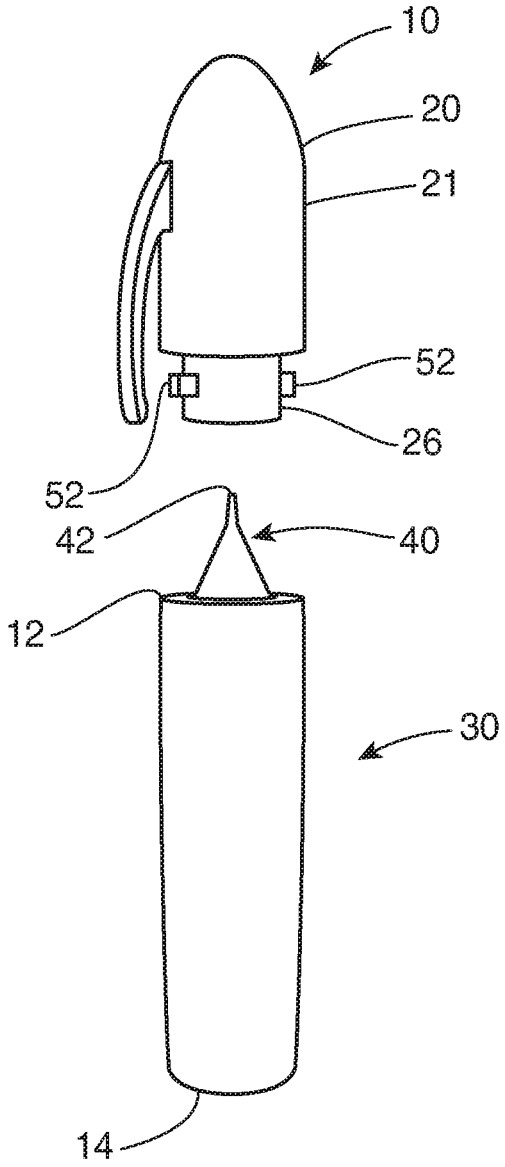
FIG. 1B is a side partially exploded elevation view of the writing instrument with locking cap as disclosed in accordance with at least one embodiment of the present invention with the cap disposed in a removed relation relative to the body portion.

As shown in the accompanying drawings, and with particular reference to FIGS. 1A and 1B, the present invention is directed to a writing instrument, generally referenced as 10, with a locking cap 20, for instance, a cap 20 that lockingly or securely engages with the body portion 30 of the writing instrument 10 in order to restrict inadvertent or unwanted removal thereof (e.g., from a child). In this manner, the writing instrument 10 of certain embodiments can be considered child-resistant in that many children will not be able to or will have great difficulty in removing the cap 20 from the body portion 30 of the writing instrument 10. It should be noted that the writing instrument 10 of the various embodiments of the present invention disclosed herein can include, but is not limited to a pen, marker, permanent marker, dry erase marker, dot marker, paint marker, felt tip pen, ball point pen, fountain pen, highlighter, etc., or virtually any like device structured and adapted to dispense ink or other like substance from an end thereof, and which may, but is not necessarily, meant to be held in an operator's or user's hand.

Specifically, with reference to FIG. 1A, the writing instrument 10, and in particular, the body portion 30 thereof, includes a first or writing end 12 and a second or bottom end 14. The second or bottom end 14, in many instances, is disposed longitudinally opposite from the first or writing end 12. The first or writing end 12 is defined as the end in which the ink (or other like substance) is dispensed from the writing instrument 10, for example, via a writing cartridge 40. For instance, the writing cartridge 40 or ink container includes at least one writing tip 42 from which the ink (or other like substance) is dispensed when writing. In many cases, as illustrated in FIG. 1B, for example, the writing tip 42 of the writing cartridge 40 will extend at least partially beyond the writing end 12 of the body portion 30 of the writing instrument 10. It should be noted that other writing cartridges 40 may be used in the full spirit and scope of the present invention, such as, for example, double ended writing cartridges, retractable or 'clicking type' writing cartridges, etc.

Figure 2:
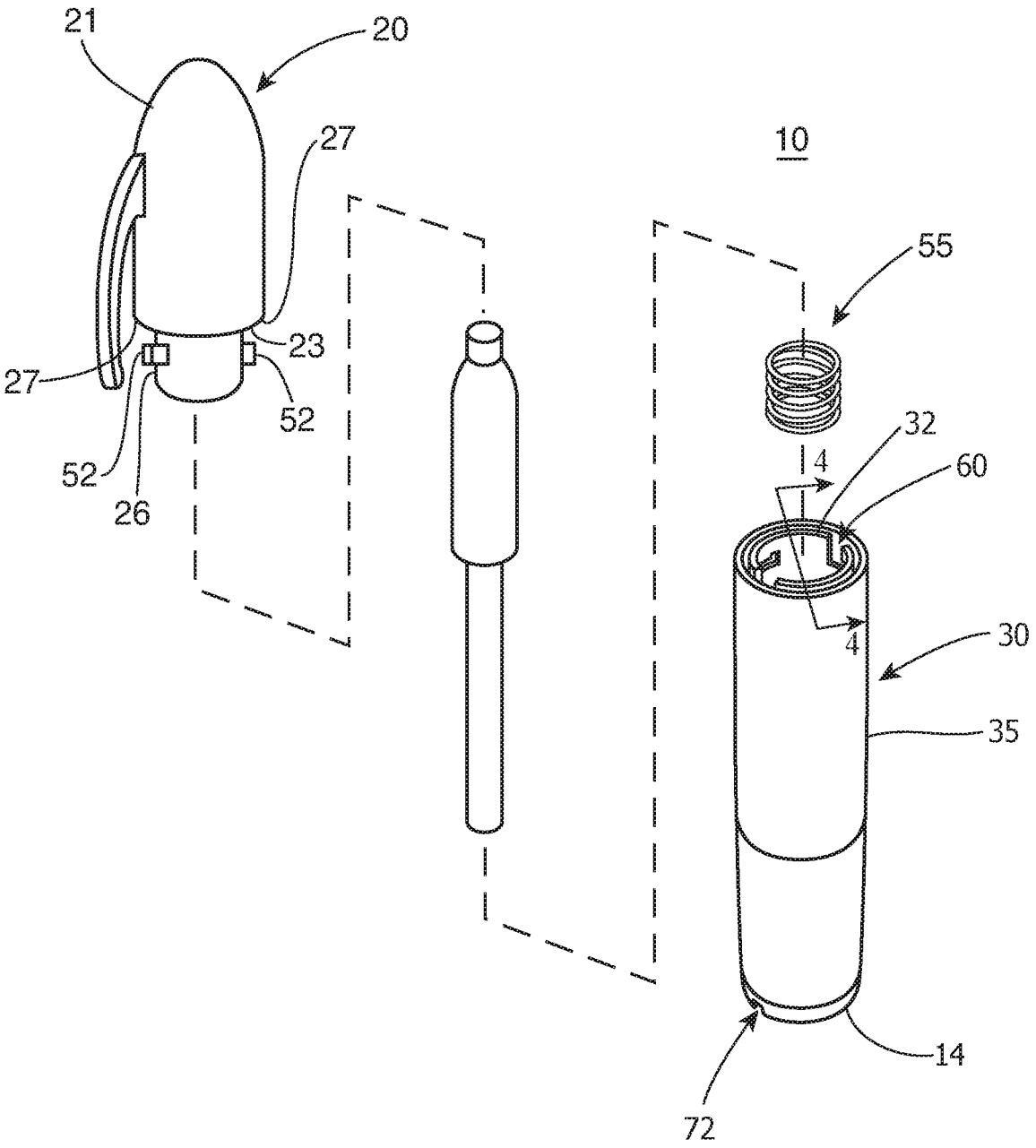
FIG. 2 is an exploded view of the writing instrument with locking cap as disclosed in accordance with at least one embodiment of the present invention.

Moreover, as shown in the exploded view of FIG. 2, the writing cartridge 40 may include a longitudinal, at least partially cylindrical device that is disposed, and in many cases, removably disposed, within an internal at least partially hollow cavity of a receiving portion of the body 30 of the writing instrument 10. The cap 20 can then be secured onto the body portion 30, thereby securing or otherwise restricting access to the writing cartridge 40 contained therein.

Figure 3:
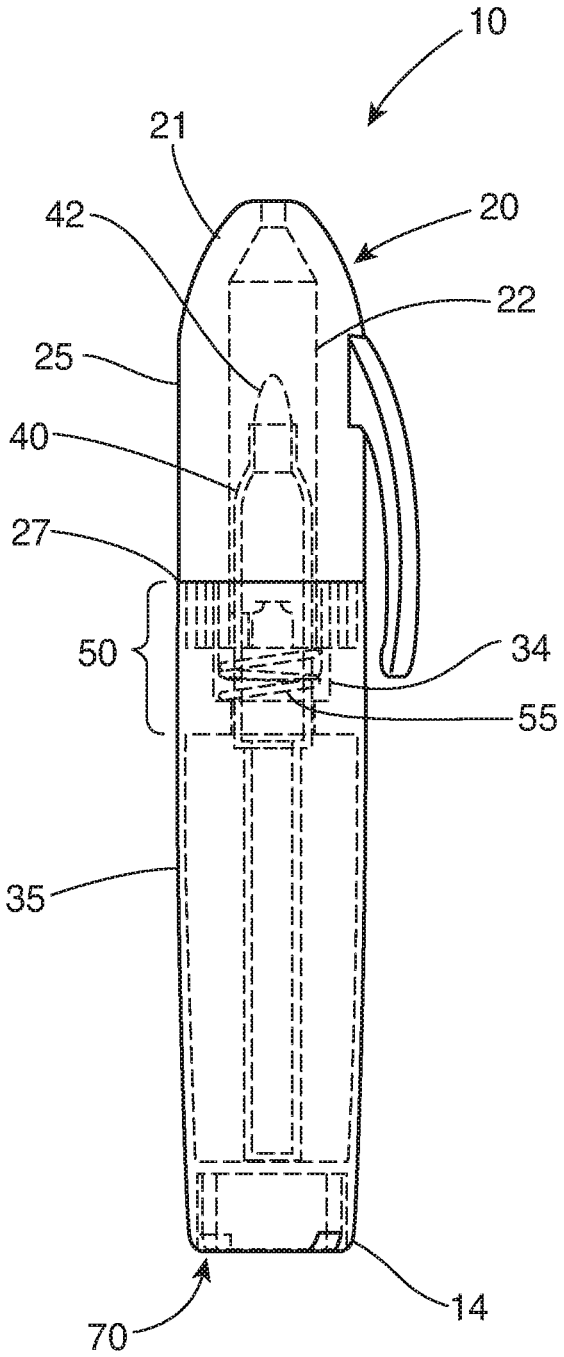
FIG. 3 is side elevation transparent view of the writing instrument with locking cap as disclosed in accordance with at least one embodiment of the present invention.

With reference now to FIG. 3, the cap 20 of at least one embodiment, includes a cap channel 22 adapted to at least partially receive the writing tip 42 of the writing cartridge 40, for example, when the cap 20 is disposed in a connected or locked engagement with the body portion 30, as illustrated. For instance, when the cap 20 is engaged with the body portion 30, the portion of the writing cartridge 40 that extends beyond the writing end 12 of the body portion 30 will be disposed within the cap channel 22. As mentioned above, however, other embodiments may include retractable writing cartridges, or other writing cartridges that may not need to be disposed within a cap channel 22.

In any event, certain embodiments of the present invention are directed to a writing instrument 10 in which the cap 20 may be selectively disposed or positioned between a removed relation from the body portion 30 (e.g., FIG. 1B)(wherein the writing tip 42 of the writing cartridge 40 may be exposed) and a locked engagement (e.g., FIGS. 1A and 3)(wherein the writing tip 42 of the writing cartridge 40 is hidden or access thereto is otherwise restricted).

In this manner, at least one embodiment includes a locking assembly 50 that is adapted and disposed to lockingly engage the cap 20 to the body portion 30 of the writing instrument 10. For instance, while many different locking assemblies 50 structured to secure or lock the cap 20 onto the body portion 30 of the writing instrument 10 are contemplated within the full spirit and scope of the present invention, at least one embodiment includes at least one locking protrusion or tab 52 and at least one cooperatively structured locking channel 60 within which the locking protrusion or tab 52 is disposed and locked. It should be noted that the illustrated embodiment shows a pair of or two locking protrusions 52 and a pair of or two locking channels 60, however, more or less locking protrusions 52 and/or locking channels 60 are contemplated. Furthermore, as illustrated, and with reference to FIGS. 2 and 4, for example, the locking protrusions(s) or tab(s) 52 are disposed on the cap 20, whereas the locking channel(s) 60 are disposed on the body portion 30. However, other embodiments may include the reverse construction, meaning that the locking channel(s) 60 may be disposed on the cap 20 with the locking protrusion(s) or tab(s) 52 disposed on the body portion 30.

Particularly, in the embodiment illustrated, and with reference to FIG. 2, for example, the cap 20 includes a main cap portion 21 and a collar 26, wherein the locking protrusion(s) 52 extend outward, e.g., laterally, from the collar 26. For instance, the collar 26 of at least one embodiment may extend downward from a lower ledge 23 of the main cap portion 21 and the locking protrusion(s) 52 extend substantially outward, e.g., laterally, from the downwardly extended collar 26. As shown, the main cap portion 21 includes an outer wall or outer surface 25 which meets the lower ledge 23 at corner 27. In some embodiments, the collar 26 extends downward below lower ledge 23, and the locking protrusion(s) 52 extend outward from the collar 26, but do not extend beyond the corner 27 where the outer surface 25 of the cap 20 and the lower ledge 23 meet.

Still referring to FIG. 2, the body portion 30 of at least one embodiment includes an outer wall 35 and inner locking wall 32. In at least one embodiment, the locking channel(s) 60 are defined by or otherwise disposed on the inner locking wall 32, and in at least one embodiment, the outer wall 35 is disposed in an at least partially covering, e.g., a circumferentially covering, relation to the inner locking wall 32. In particular, in at least one embodiment, the inner and outer walls 32, 35, respectively, may be concentrically disposed relative to one another, however, they need not be so related in other embodiments.

Figure 4:
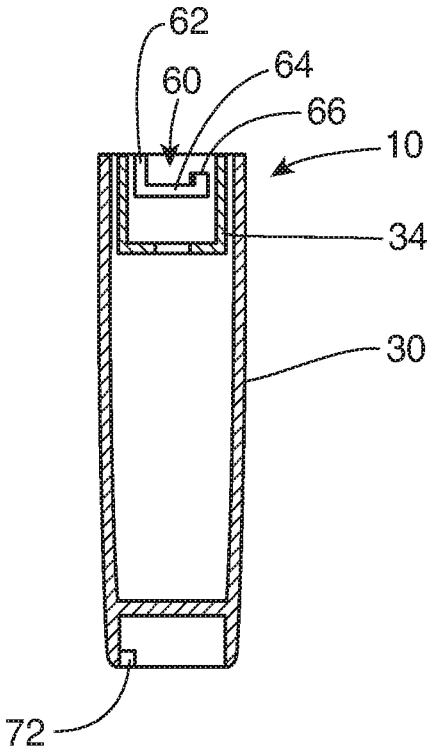
FIG. 4 is a cut-away or sectional view along line 4-4 of FIG. 2.
Figure 6:
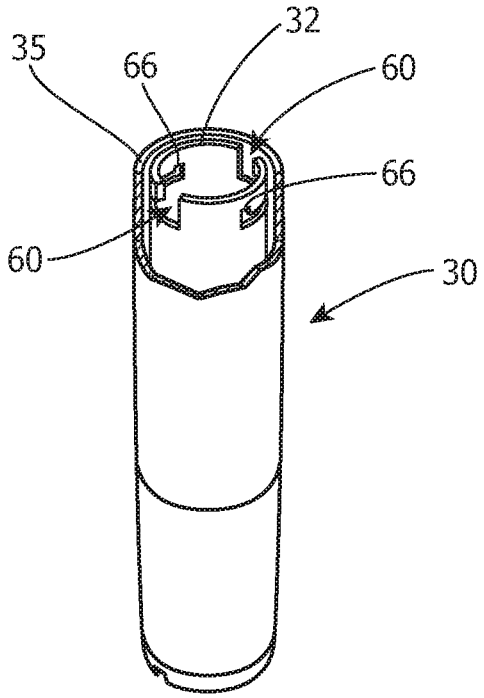
FIG. 6 is a partial cut-away view of the body portion of the writing instrument as disclosed in accordance with at least one embodiment of the present invention.

With reference now to the cut-away or sectional views of FIG. 4 (taken along line 4-4 in FIG. 2) and FIG. 6, at least one of the locking channels 60 of one embodiment is illustrated. Specifically, the locking channel 60 may include an at least partially "U" shaped configuration, as shown. For instance, the locking channel(s) 60 may be structured to include an opening groove, referenced as 62, an inner groove or intermediate groove, referenced as 64, and a locking or end notch, referenced as 66. For instance, the opening groove 62 comprises an open end, for example, at an upper or exposed edge of the inner wall 32, and may extend downward or in a longitudinal direction along the inner wall 32, within which one of the locking protrusions 52 may be positioned or inserted, for example, when locking the cap 20 to the body portion 30 of the writing instrument 10. The locking protrusion or tab 52 can then slide along or within the inner or intermediate groove 64 of the locking channel 60 toward the closed end or locking notch 66. The inner or intermediate groove 64 may extend at least partially or substantially in a lateral direction along the inner wall 32, for example, in an at least partially angular relation (e.g., at least partially perpendicular or orthogonal) to the opening groove 62. Furthermore, the locking notch 66 may extend at least partially or substantially in an upward direction from the end of the inner or intermediate groove 64 or otherwise in a longitudinal manner along the inner wall 32 and at least partially angularly disposed (e.g., at least partially perpendicular or orthogonal) from the inner or intermediate groove 64.

In particular, the locking assembly 50 of at least one embodiment further includes a biasing device referenced as 55, such as a mechanical spring, coil spring, or other like elastic object used to store mechanical energy. The biasing device 55 of at least one embodiment may be disposed within the body portion 30 of the writing instrument 10 proximate the locking channel(s) 60, for example, within a biasing retention portion 34, for engagement with the cap 20. In particular, disposition of the cap 20 into the locking engagement with the body portion 30 will cause the cap 20 to engage the biasing device 55 and, in at least one embodiment, at least partially compress the biasing device 55, causing the biasing device 55 to exert a biasing force upon the cap 20.

For example, in at least one embodiment, a portion of the cap 20, e.g., the collar 26 thereof, may be at least partially disposed within the body portion 20, e.g., within the inner wall 32 thereof, while the locking protrusion(s) 52 are disposed within the locking channel (2) 60, and in particular, the opening groove 62 thereof. Upon doing so, the cap 20, and in particular, the collar 26 thereof, will engage or otherwise at least partially compress the spring or other biasing device 55 seated within the biasing device retention portion 34. The cap 20 will thus be pushed into the body portion 30 against the biasing force of the biasing device 55 as the locking protrusions enter the locking channels 60.

Twisting or rotating of the cap 20 (e.g., in a clockwise rotation in the embodiment of FIG. 2, although other orientations, including a counter-clockwise rotation, are contemplated) will cause the locking protrusions 52 to slide along the inner or intermediate groove 64 of the locking channel 60 and toward the closed end or locking notch 66. When the cap 20 has been twisted or rotated enough such that the locking protrusions 52 reach the end or locking notch 66 of the locking channel 60, the biasing device 55 will cause the cap 20 to be pushed slightly up, or otherwise cause the locking protrusions 52 to be biased into the locking notch 66 of the locking channel 60.

With the biasing device 55 biasing the cap 20 such that the locking protrusions 52 are biased into the locking notches 66 of the locking channels 60, the cap 20 is thereby disposed in the locked engagement with the body portion 20 of the writing instrument 10. In this regard, attempts to rotate the cap 20 in a counter-clockwise direction (in the illustrated embodiment), without first pushing against the biasing force, will not cause the cap 20 to be removed from the body portion 30. This is because the locking protrusions 52 are locked or biased into the locking notches 66 via the biasing device 55.

It should also be noted that in at least one embodiment, with the cap 20 disposed in the locked engagement with the body portion 30 of the writing instrument 10, physical access to the locking assembly 50, and in particular, to the locking protrusions 52, locking channels 60 and biasing device 55, is at least partially restricted from a position external to the writing instrument. For example, with reference to FIGS. 1A and 3, the body portion 30 and the cap 20 cover, either entirely or at least substantially, the locking assembly 50 within the writing instrument 10, such that physical access to the components of the locking assembly 50 is restricted. This restricts any tampering, damaging or interfering with the locking assembly 50, particularly by those individual (such as children) who may not know how to open, remove or unlock the cap 20.

Particularly, the outer wall 35 of the body portion 30 and the outer wall 25 of the cap 20 may come close, meet or be substantially flush or adjacent with one another as illustrated FIGS. 1A and 3. However, there may be a small space or gap between the lower ledge 23 of the cap and the upper ledge of the body portion in order to allow for clearance for the cap 20 to be pushed inward toward the body portion 30 in order to unlock or remove the cap 20 from the body portion 30, as described in accordance with at least one embodiment herein.

Instead, in order to remove the cap 20 from the locked engagement, the user or operator must first push the cap 20 against the biasing force of the spring or other biasing device 55 such that the locking protrusions 52 can enter the inner or intermediate grooves 64 of the locking channels 60. Only then can the cap 20 be rotated (e.g., counter-clockwise) sliding the locking protrusions 52 along the inner or intermediate groove 64 toward the opening groove 62. Once the locking notches 52 have reached the opening grooves 62 of the locking channels 60 (via an appropriate amount of twisting or rotating of the cap 20), the cap 20 can be removed from the body portion 30 by removing the locking protrusions 52 from the locking channels 60, e.g., through the opening grooves 62. In some embodiments, the spring or other biasing device 55 will assist in the removal of the locking protrusions 52 from the locking channels 60 by exerting a biasing force upon the cap 20, thereby pushing the cap 20 in an off or removal direction, e.g., by at least partially pushing the locking protrusions 52 out of the locking channels 60 through the opening grooves 62.

Figure 5:
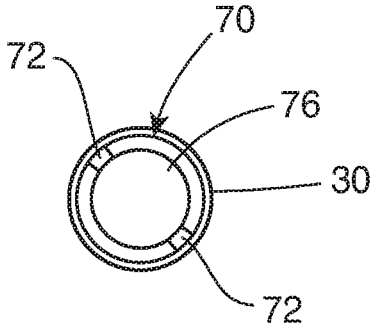
FIG. 5 is a bottom view of the writing instrument with locking cap as disclosed in accordance with at least one embodiment of the present invention.

Furthermore, with reference to the bottom view of FIG. 5, the body portion 30 of at least one embodiment includes a cooperatively structured recess 70 disposed at the bottom end 14 thereon. The recess 70 is adapted to receive a portion of the cap 20, and in particular the collar 26 and locking protrusion(s) 52 thereon in a manner such that the cap 20 can be engaged to the bottom end 14 of the body portion 30, for example, while the writing instrument is in use.

Specifically, in at least one embodiment, the recess 70 includes an annular or other like cooperating groove 76 structured to receive the collar 26 of the cap 20, with one or more notches 72 extending therefrom adapted to receive the locking protrusion(s) 52. In this manner, with the writing instrument 10 open, the cap 20 can be pushed into the bottom end 14 of the body portion 30 where the cap 20 can be retained. In some embodiments, the recess 70 at the bottom end 14 of the body portion 30 may include an inward groove where the cap 20 is simply pushed into. Other embodiments may include inner, lateral grooves (not shown) with locking notches (not shown) and/or a spring (not shown), similar to the locking grooves 60 disclosed herein. Yet additional embodiments of the recess 70 may include inner, lateral grooves and/or locking notched such that the cap can be pushed in and twisted, but without the inclusion of the biasing spring.

FIGS. 7 through 12 illustrate yet another embodiment of the writing instrument 10 of the present invention. Specifically, the embodiment illustrated in FIGS. 7 through 12 do not require the use of a spring longitudinally biasing the cap 20, as provided in the above description. Rather, one or more nodes or notches 65 disposed within the locking channel(s) 60, along with cooperating flexible portions 125 and locking tabs 52, function to at least partially retain the cap 20 in a locked orientation relative to the body 30.

Figure 7:
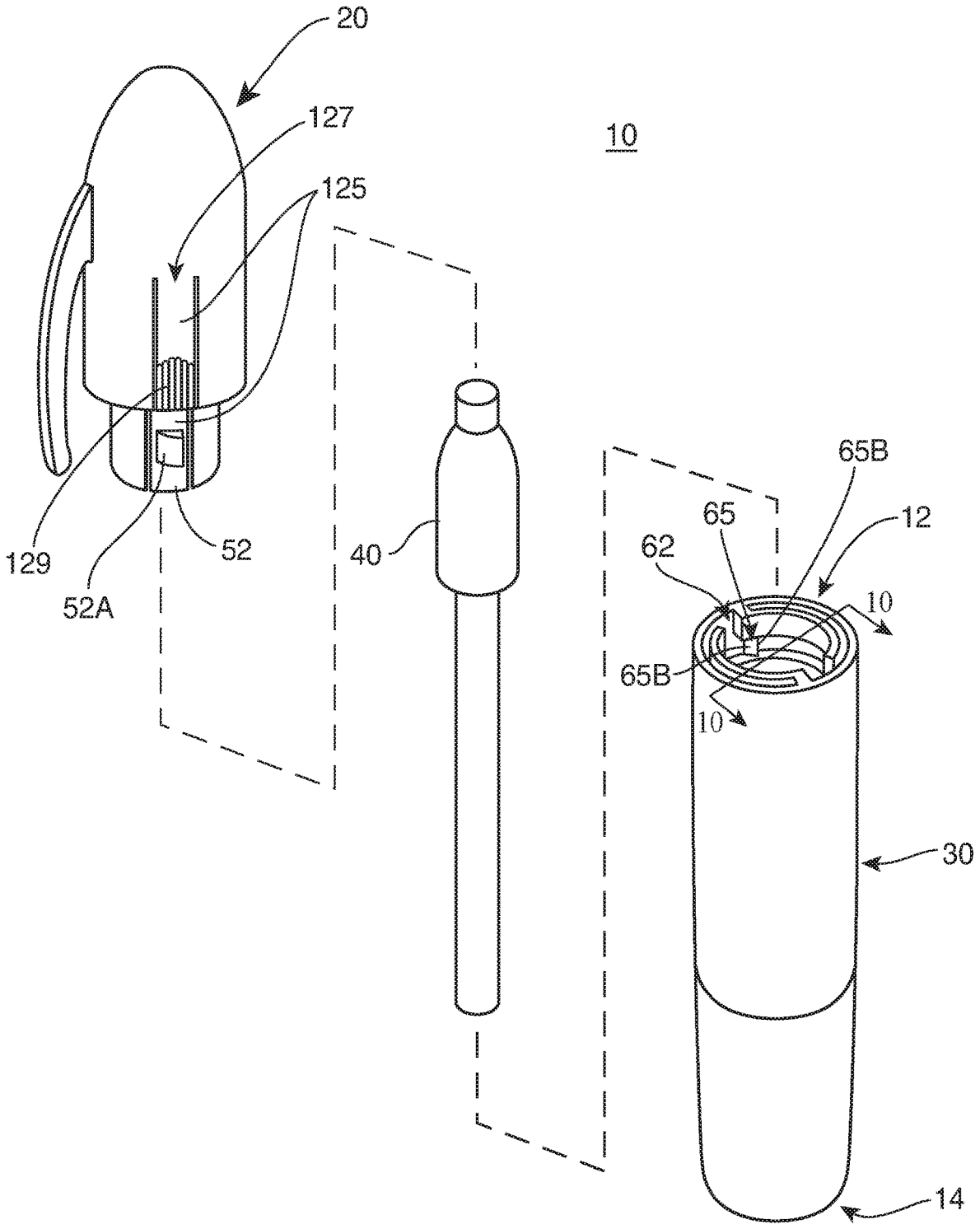
FIG. 7 is an exploded view of yet another embodiment of the present invention as disclosed herein.
Figure 8:
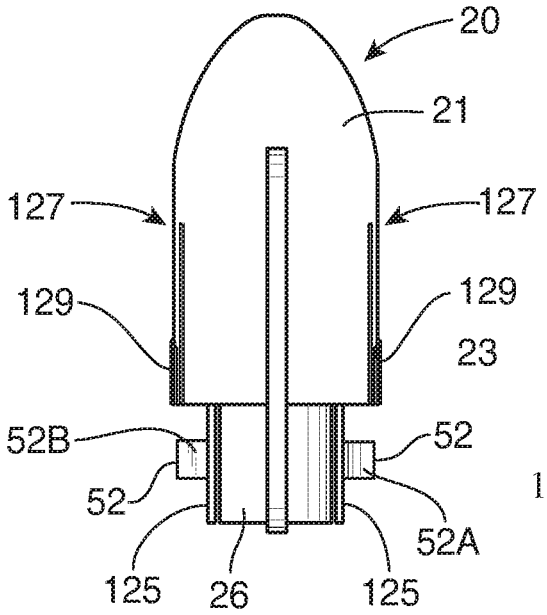
FIG. 8 is a side view of the cap as disclosed in accordance with the embodiment shown in FIG. 7.
Figure 9:
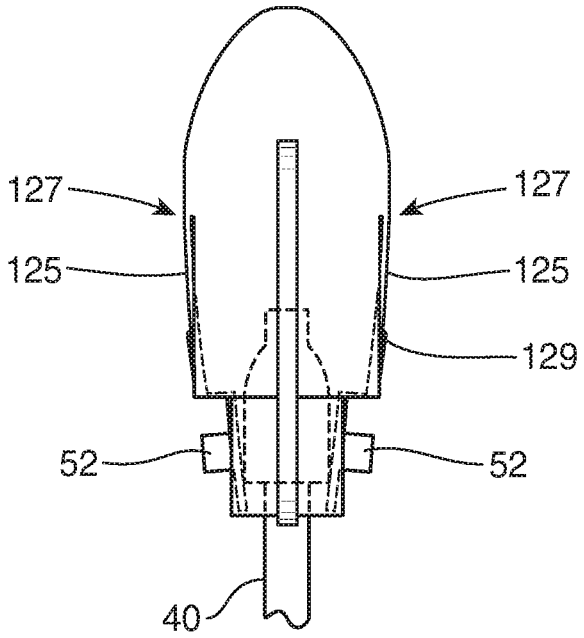
FIG. 9 is a side view of the cap illustrated in FIG. 8 with a writing cartridge disposed therein and with two flexible sections flexed inward.

For instance, with reference to FIGS. 7, 8 and 9, the cap 20 of at least one embodiment includes one or more flexible sections, generally referenced as 125. The flexible sections 125 may extend from the main cap portion 21 continuously down to the collar 26, and can be flexed or squeezed inward. Specifically, when a user manually squeezes or pinches the cap 20 at flexible section(s) 125, such as, but not limited to at finger grip sections 129, the flexible sections 125 will flex or bend inward, as shown in FIG. 9, for example. Particularly, the flexible sections 125 may be constructed as a living hinge, or otherwise, a portion of the cap 20 that has longitudinal cuts allowing the flexible sections 125 to flex inward, such as, at hinge or point 127. In some embodiments, when the user releases the flexible sections 125, the flexible sections 125 will automatically flex back into the normal unbiased or unflexed position, as illustrated in FIG. 8.

Since the flexible sections 125 have one or more locking tabs 52 disposed thereon, particularly, at or near the bottom or collar 26 portion thereof, as illustrated, flexing or bending of the flexible sections 125 will cause the locking tabs 52 to also flex or bend inward. As described herein, this allows the locking tabs 52 to pass over one or more nodes 65 disposed within or along the locking channel(s) 60.

Figure 10:
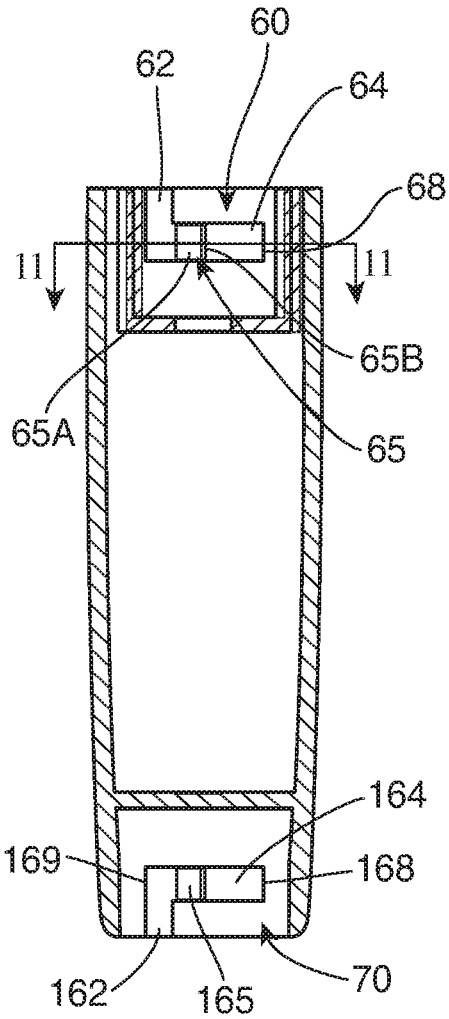
FIG. 10 is a cut-away view of the body portion of the writing instrument along line 10-10 in FIG. 7.

More in particular, with reference to FIGS. 7 and 10, for example, the locking channels 60 of at least one embodiment include a node 65 or protrusion disposed therein. The protrusion or node 65 is structured to contact or engage the locking tab(s) 52 of the cap to restrict removal of the cap 20 or twisting of the cap in one direction, absent a manual squeezing or pinching of the one or more flexible sections 125.

For instance, in use, in order to place the cap 20 onto the body 30 of the writing instrument, the cap 20 is disposed onto the body 30 with the one or more locking tabs 52 aligned with the opening groove 62 of the locking channels 60. The cap 20 is pushed down slightly until the locking tabs 52 can pass along inner groove 64 when the cap 20 is twisted or rotated in one direction (e.g., clockwise in the embodiment illustrated in FIG. 7). Rotation of the cap 20 in a first (e.g., clockwise) direction will cause the locking tabs 52 to contact the nodes 65 constructed within the locking channels 60.

In at least one embodiment, the locking tabs 52 must pass over the nodes 65 in order to position the locking tabs 52 between the nodes and the distal end 68 of the locking channel 60. For example, in one embodiment, the locking tabs 52 may, but do not necessarily need to, include a sloped, tapered or angled surface 52A that will face or contact the corresponding node 65. The sloped, tapered or angled surface 52A is sloped or angled out from the collar 26 away from the direction of rotation in a manner such that when the sloped or angled surface 52A of the locking tab 52 contacts the node 65, the tab 52 will slide or pass over the node 65 without much effort by the user. Specifically, as the user rotates the cap 20 while the tabs 52 are within corresponding locking channels 60, the tabs 52 can easily contact and slide or pass over the node 65 via the sloped surface 52A. The flexible section 125 of the cap 20 may flex slightly inward without manually squeezing them due to the sloped surface and passage of the tabs 52 over the nodes 65.

Although not shown in the drawings, it should be noted that the tab(s) 52 of some embodiments do not include a sloped surface, but may instead be generally rectangular or square shaped, for example, with flat or generally perpendicular opposing front (leading) and back (rear) sides. In such a case, the node(s) 65 may, but do not necessarily need to, include a sloped surface such that the tab(s) 52 can easily pass over the node(s) 65 when the cap 20 is twisted in at least one direction.

For instance, still referring to FIGS. 7 and 10, the nodes 65, themselves, may include a sloped, angled or tapered leading surface 65A in order to facilitate the passage of tabs 52 thereby. In this regard, the sloped, angled or tapered surface 65A of the node 65 may correspond with the sloped, angled, or tapered surface 52A of the tabs 52 such that the surfaces substantially match up with one another allowing the tabs to easily pass by. Even if the tab(s) 52 do not have a sloped leading surface, the sloped surface 65A of the node(s) 65 can facilitate passage of the tab(s) 52 in at least one direction.

It should also be noted that, while rotating the cap 20 into a locked position, a user may squeeze or pinch the flexible section(s) 125, thereby causing the tabs 52 to flex inward, in order to cause the tabs 52 to clear or at least partially clear the nodes 65. In this manner, by squeezing the flexible sections 125, the tabs 52 may not, in some cases, contact or engage the nodes 65 when the cap 20 is rotated into the locked position.

Accordingly, once the locking tab(s) 52 has/have cleared or passed the corresponding node(s) 65, the locking tab(s) 52 will be disposed within the locking channel(s) 60, between the node(s) 65 and the distal end 68 of the channel(s) 60. While in this position, the cap 52 is considered to be in the locked orientation. For instance, the cap 20 cannot be, or is otherwise restricted from being, pulled off of the body 30 while the locking tabs 52 are within the locking channel 60, for example, between the nodes 65 and the distal end 68 of the channel 60. Similarly, absent manual squeezing or flexing of the flexible sections 125, the cap 20 cannot be, or is otherwise restricted from being, rotated in the opposite direction (e.g., counterclockwise) in a manner to allow the tabs 52 to exit the channels 60 at the opening 62. This is because, the tabs 52 will contact or engage the nodes 65.

More particularly, locking edge 52B of the tabs 52 will engage or contact locking edge 65B of the nodes 65. In at least one embodiment, locking edges 52B and/or 65B may be perpendicular or flat, thereby restricting further rotational movement upon engagement thereby. Accordingly, in order to unlock the cap 20, or otherwise, in order to allow the locking tabs 52 to clear or pass over the nodes 65 from the locked position to an unlocked position, a user may squeeze or pinch the flexible sections 125 of the cap 20, thereby causing the locking tabs 52 to be pressed or flexed inward. The inward flexing or movement of the locking tabs 52 is enough for the locking tabs 52 to clear the nodes 65, allowing the cap 20 to be rotated in the second direction (e.g. counterclockwise in the illustrated embodiment). This allows the tabs 52 to clear the nodes 65 such that the tabs 52 can exit the locking channels 60, for example, through opening groove 62, and the cap 20 can be pulled off of the body 30.

Figure 11:
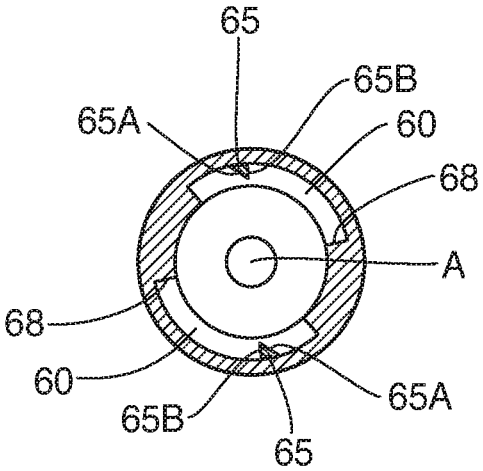
FIG. 11 is a cut-away view of the body portion of the writing instrument along line 11-11 in FIG. 10.

With reference to FIG. 11, in at least one embodiment, the distal end of the locking channel 68 extends inward toward a central axis A of the body portion 30 further than the nodes 65 extend. For example, the apex or outer end of nodes 65 of at least one embodiment do not extend all the way to the edge of the channel, but instead only occupy a portion of the width of the channel 60. This helps facilitate movement of the tabs 52 over the nodes 65, while restricting or preventing movement of the tabs 52 beyond the distal end 68 of the channel 60. More specifically, and referring again to FIG. 9, the writing cartridge 40 will extend at least partially within the collar 26 of the cap 20. As shown in FIG. 9, the flexible sections 125 of the cap 20 of at least one embodiment, will engage or contact the writing instrument 40 if the flexible sections 125 are flexed or bent inward enough. In this manner, the writing instrument 40 can be used to prevent the flexible sections 125 from flexing inward too far or otherwise inward beyond the writing instrument 40.

Accordingly, the space between the writing cartridge 40 and the cap 20 or otherwise between the writing cartridge 40 and the flexible sections 125 allows the flexible sections 125 to flex inward enough so that the locking tabs 52 are able to clear the nodes 65, but not enough for the locking tabs 52 to clear the distal end 68 of the channel 60. In this regard, when the locking tabs 52 are disposed between the nodes 65 and the distal end 68 of the channels 60 (i.e., when the cap is locked to the first end of the body), if the cap 20 is rotated in a direction such that the locking tabs 52 (e.g., the leading sloped surfaces 52A of the locking tabs 52) contact the distal end 68 of the channel 60, the flexible sections 125 will not be able to flex inward enough to allow the tabs 52 to pass over the distal end 68 of the channel 60. As mentioned above, rotation of the cap 20 in the other direction (e.g., counterclockwise) will cause the locking surfaces 52B, 65B of the locking tabs 52 and nodes 65, respectively, to engage one another, thereby restricting further rotational movement. Flexing of the flexible sections 125 inward, however, will allow the tabs 52 to pass over the nodes 65, thereby allowing the cap to be removed or released from the body.

Figure 12:
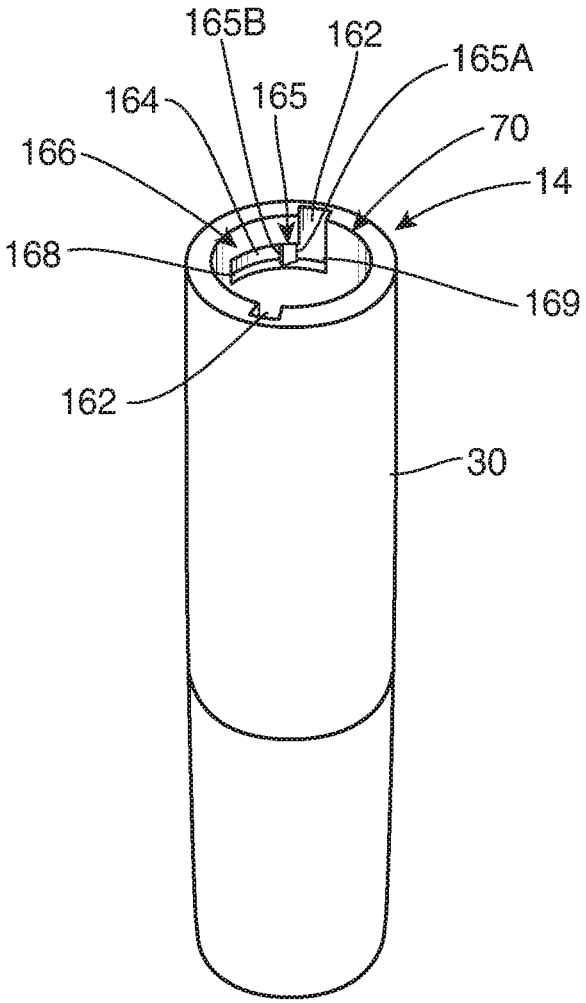
FIG. 12 is a bottom perspective view of the body portion of the writing instrument as disclosed in accordance with at least one embodiment herein.

With reference now to FIGS. 10 and 12, for example, the bottom or second end of the body 30 may include one or more storage channels 160 adapted to receive one or more locking tabs 52, as described herein. For instance, the body portion 30 of at least one embodiment includes a cooperatively structured recess 70 disposed at the second or bottom end 14 thereon. The recess 70 is adapted to receive a portion of the cap 20, and in particular the collar 26 and locking protrusion(s) 52, in a manner such that the cap 20 can be engaged to the second or bottom end 14 of the body portion 30, for example, while the writing instrument is in use. This allows a user to store the cap 20 on the bottom of the body 30 while the writing tip is exposed at the other end.

Still referring to FIGS. 10 and 12, channels 160 may have an L-shaped configuration defined by an opening groove 162 and an inner groove 164. In the embodiment shown, the channels 160 include nodes 165 disposed along a length thereof. Similar to the nodes 65 disclosed above, the nodes 165 may include a leading sloped surface 165A and an opposite locking surface 165B. The leading sloped surface 165A helps facilitate the passage of the locking tabs 52 from the cap 20 to pass over when the cap is rotated.

In at least one embodiment, when the cap 20 is disposed at least partially within the storage channels 160, or otherwise, while the locking tabs 52 are disposed within the storage channels 160, the flexible sections 125 of the cap 20 can flex inward far enough to allow the cap to continuously rotate in at least one direction (e.g., clockwise) without the need to manually squeeze or pinch the flexible sections 125. Specifically, since the locking tabs 52 of at least one embodiment include a sloped surface 52A, rotation of the cap within the storage channel 160 in the direction such that the sloped surface 52A is leading (e.g., clockwise in the embodiment of the cap 20 illustrated in FIG. 7 for example), the sloped surface 52A will cause the tab 52, and the flexible section 125, to bend or flex inward when the tab 52 or surface 52A contacts either the node 165 or one of the ends 168, 169 of the channel 160.

As an example, if the collar 26 of cap 20 was disposed within the recess 70 of the embodiment shown in FIG. 12, rotation of the cap 20 in a clockwise direction would cause the leading sloped surface 52A of the tabs 52 to engage end 169. The sloped surface 52A will allow the tab 52 to flex inward, allowing the cap to continue to rotate clockwise. The same tab 52 will then enter the next channel (the channel not shown in FIG. 12). This can continue, allowing the cap to continue to rotate clockwise without the need to manually press or squeeze the flexing sections 125. Rotation of the cap 20 in the opposite direction (e.g., counterclockwise) would cause the flat surface 52B of the tab 52 to engage the flat surface 168 of the channel, thereby restricting further movement in that direction, unless the flexible sections 125 are manually squeezed inward until the tabs 52 clear the surface 168.

This allows the cap to be freely rotated in one direction (e.g., clockwise) to release the cap 20 from the storage channel 160 without the need to manually squeeze the flexible sections 125. This is because, maintaining the cap 20 in a locked positioned or child-proof position when in the storage channel 160 is less of a necessity than keeping the cap locked to the top or writing end of the body.

In the embodiment shown, for example, in FIG. 12, the storage channels 160 extend in an opposite direction than the channels 60. For instance, with reference to FIG. 7, the channels 60 form an "L-shape," such that the inner groove 64 extend clockwise from opening 62, whereas in FIG. 12, the channel forms a reverse "L-shape," such that the inner groove 164 extends in a counterclockwise direction from opening 162. It should be noted that in some embodiments, the channels 60, 160 may extend in the same direction.

Also, for illustrative purposes, if the cap 20 of at least one embodiment, is engaged to the first end 12 of the body 30 with the ink cartridge or writing cartridge 40 removed, the cap 20 will be able to rotate continuously in one direction (e.g., clockwise) with the sloped surface 52A of the tabs 52 engaging the nodes and the ends 68 of the channels 60. This is because, without the writing cartridge in place, the flexible sections 125 can flex inward further in that the writing cartridge 40 will not be engaged by the flexible sections and therefore will not restrict the inward flexing thereof. It is this reason that allows the cap 20 to continuously rotate in one direction (e.g., clockwise) when the cap is engaged within the storage channel 160—because there is nothing in the center to restrict the inward flexing of flexible sections 125. Some embodiments, however, may include a restriction piece (not shown) that will extend from the center of the bottom end and enter into the collar 26 of the cap 20. The restriction piece can thus be used to restrict further inward flexing of the flexible sections 125 beyond a certain point, thereby locking the cap 20 in place, similar to how the cap 20 locks to the first end 12 when a writing cartridge is installed.

It should also be noted that in some embodiments, the writing instrument 10 of the present invention may be constructed such that the locking mechanism(s) (e.g., the locking tab(s) 52 and/or channel(s) 60) are disposed on this inside of the writing instrument 10 when the cap 20 is closed or engaged on the body. This can serve a number of purposes, aesthetically and functionally. For example, in some cases, the tab(s) 52 and/or channel(s) 60 are restricted from access and thereby tampering with them is restricted. Also, the writing instrument 10, as a whole, when the cap is on the base, has an external appearance that does not readily appear to have a locking cap. In particular, the writing instrument may substantially appear like an ordinary pen, marker, highlighter, etc., while substantially hiding many of the locking characteristics and features from external view.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A writing instrument, comprising:

a body portion, a writing cartridge, and a cap, said body portion comprising a first end and a second end, said second end being disposed longitudinally opposite from said first end, said writing cartridge being disposed substantially within said body portion, said writing cartridge comprising a writing tip extending at least partially beyond said first end of said body portion, said cap comprising a main cap portion and a collar extending from one end of said main cap portion, said cap being selectively positionable into a locked engagement with said first end of said body portion via a locking assembly, said locking assembly comprising at least one locking tab disposed on said collar of said cap, and at least one cooperatively structured locking channel disposed on said body portion, said at least one locking tab adapted to fit within said locking channel to dispose said cap in said locked engagement with said body portion wherein said cap comprises at least one flexible section adapted to be squeezed inward from a normal unbiased position, said at least one locking tab being disposed on said at least one flexible section, wherein said at least one flexible section extends along at least part of said main cap portion and onto said collar portion, wherein said at least one locking channel comprises an L-shaped configuration defined by an opening groove and an inner groove connected to one another at an angle, said locking channel comprising a node disposed therein, wherein said at least one locking tab will contact said node as said locking tab travels through said locking channel, said at least one locking tab comprising an at least partially sloped surface, wherein said at least partially sloped surface will contact and pass over said node as said cap is disposed into said locking engagement with said body portion, wherein said at least one locking tab is disposed between said node and a distal end of said locking channel when said cap is disposed in said locked engagement with said body portion, said at least one locking tab and said node are cooperatively configured to restrict movement of said at least one locking tab past said node in a direction toward said opening groove absent manual squeezing of said flexible section of said cap inward, wherein said at least one locking tab comprises a generally flat locking surface that will engage said locking surface of said node, thereby restricting movement of said locking tab past said node in the direction toward said opening groove absent manual squeezing of said flexible section of said cap inward, wherein said distal end of said locking channel extends inward toward a central axis of said body portion further than said node extends inward toward said central axis of said body portion, and wherein said writing cartridge extends at least partially within said collar of said cap, and wherein said flexible portion of said cap will engage said writing cartridge if flexed inward enough, thereby preventing further inward flexing of said flexible portion of said cap.

2. The writing instrument as recited in claim 1 wherein said node comprises an at least partially sloped surface facing said opening groove, and a locking surface facing a distal end of said locking channel.

3. The writing instrument as recited in claim 1 further comprising a space between said writing cartridge and said flexible portion of said cap allowing said flexible portion of said cap to flex inward enough to pass over said node when locking said cap to said body portion but restricting said flexible portion from flexing inward enough to pass over said distal end of said locking channel, thereby locking said at least one locking tab between said node and said distal end of said locking channel, absent manual squeezing of said flexible portion enough to clear said node.

4. A writing instrument, comprising:

a body portion and a cap, said body portion comprising a first end and a second, said second end disposed longitudinally opposite from said first end, said cap being selectively positionable between an at least partially locked engagement with, and a removed relation from, said first end of said body portion and said second end of said body portion, a writing cartridge disposed at least substantially within said body portion of said writing instrument, said writing cartridge comprising a writing tip extending at least partially beyond said first end of said body portion, said cap comprising a cap channel adapted to at least partially receive said writing tip of said writing cartridge when said cap is positioned in said locked engagement with said first end of said body portion, said cap comprising a main cap portion and a collar, said cap further comprising two flexible sections disposed on substantially opposite sides of said cap and extending longitudinally along part of said main cap portion to said collar, said flexible sections adapted to be squeezed inward from a normal unbiased position, at least two locking tabs disposed on said collar, wherein at least one of said two locking tabs is disposed on one of said flexible portions of said cap and another one of said two locking tabs is disposed on another one of said flexible portions, at least two locking channels disposed within said body portion, said at least two locking tabs adapted to fit within said at least two locking channels to dispose said cap in said locked engagement with said base, each of said at least two locking channels comprise an L-shaped configuration defined by an opening groove and an inner groove, each of said at least two locking channels comprising a node disposed within said inner groove thereof, wherein said at least two locking tabs are disposable first through said opening grooves and then along said inner grooves of said locking channels, wherein rotational movement of said cap relative to said body in a first direction causes said at least two locking tabs to pass over said nodes disposed within said locking channels, and wherein said locking tabs and said nodes are cooperatively configured to restrict movement of said locking tab past said nodes when said cap is rotated in a second direction, opposite said first direction, absent manual squeezing of said flexible section of said cap inward.

5. The writing instrument as recited in claim 4 further comprising at least two storage channels disposed at said second end of said body portion, each of said storage channels being configured to receive at least one of said at least two locking tabs of said cap therein to at least partially engage said cap to said second end of said body portion.

6. The writing instrument as recited in claim 4 wherein a bottom edge of said main portion of said cap is disposed in a substantially aligned relation with one outer surface of said body portion when said cap is disposed in said locked engagement with said first end of said body portion.

7. A writing instrument, comprising:

a body portion, a writing cartridge, and a cap, said body portion comprising a first end and a second end, said second end being disposed longitudinally opposite from said first end, said writing cartridge being disposed substantially within said body portion, said writing cartridge comprising a writing tip extending at least partially beyond said first end of said body portion, said cap comprising a main cap portion and a collar extending from one end of said main cap portion, said cap being selectively positionable into a locked engagement with said first end of said body portion via a locking assembly, said locking assembly comprising at least one locking tab disposed on said collar of said cap, and at least one cooperatively structured locking channel disposed on said body portion, said at least one locking tab adapted to fit within said locking channel to dispose said cap in said locked engagement with said body portion, and at least one storage locking channel disposed at said second end of said body portion, said storage locking channel being configured to receive said at least one locking tab of said cap therein to at least partially engage said cap to said second end of said body portion, wherein rotation of said cap in a first direction relative to said body portion, when said locking tab is disposed within said storage locking channel, will dispose said locking tab between a corresponding node and a distal end of said storage locking channel, and further rotation of said cap in said first direction is restricted by a generally flat surface of said locking tab and said distal end of said storage locking channel.

8. The writing instrument as recited in claim 7 wherein rotation of said cap in a second direction, opposite said first direction, relative to said body portion, will allow a leading, sloped surface of the locking tab to freely pass over said corresponding node without manually flexing said flexible portion of said cap, thereby allowing said cap to be removed from said storage locking channel without manually flexing said flexible portion of said cap.

* * * * *